US005122390A

United States Patent [19]

Rearick et al.

[11] Patent Number: 5,122,390

[45] Date of Patent: Jun. 16, 1992

[54] METHOD FOR UNIFORMLY COATING A PROBE WITH DIELECTRIC AND ASSEMBLING A COAX-TO-WAVEGUIDE TRANSITION

[75] Inventors: Charles C. Rearick, Cherry Hill Township, Camden County, N.J.; Samuel C. McCoach, West Rockhill Township, Bucks County; Charles W. Di Maria, Springfield Township, Montgomery County, both of Pa.

[73] Assignee: General Electric Company, Moorestown, N.J.

[21] Appl. No.: 587,195

[22] Filed: Sep. 24, 1990

[51] Int. Cl.[5] ..... C23C 26/00

[52] U.S. Cl. ..... 427/117; 427/58; 427/430.1; 427/434.6; 427/127

[58] Field of Search ..... 427/117, 58, 430.1, 427/434.6, 127; 29/600

[56] References Cited

U.S. PATENT DOCUMENTS

| | | | |
|---|---|---|---|
| 138,767 | 5/1873 | Shepard . | |
| 431,906 | 7/1890 | Medford . | |
| 1,091,527 | 8/1914 | Moore . | |
| 1,346,726 | 7/1920 | Thompson . | |
| 1,393,860 | 10/1921 | Weeks . | |
| 2,257,432 | 9/1941 | Smith . | |
| 3,131,093 | 4/1964 | Wildebour . | |
| 3,304,201 | 2/1967 | Boehm | 427/117 |
| 3,463,339 | 8/1969 | McGuckin . | |
| 3,913,522 | 10/1975 | Light . | |
| 3,938,686 | 2/1976 | Milligan et al. . | |
| 4,051,450 | 9/1977 | Barlow | 333/240 |
| 4,269,870 | 5/1981 | Boynton . | |
| 4,307,934 | 12/1981 | Palmer . | |
| 4,331,254 | 5/1982 | Haggerty . | |
| 4,362,698 | 12/1982 | Boosalis et al. . | |
| 4,461,041 | 7/1984 | Dobrovolny | 455/328 |
| 4,518,633 | 5/1985 | Walling | 427/117 |
| 4,535,722 | 8/1985 | Kondo . | |
| 4,549,310 | 10/1985 | Woodward | 333/251 |
| 4,699,455 | 10/1987 | Erbe et al. . | |
| 4,753,510 | 6/1988 | Sezerman . | |
| 4,848,641 | 7/1989 | Park et al. . | |

*Primary Examiner*—Shrive Beck
*Assistant Examiner*—Vi Duong Dang
*Attorney, Agent, or Firm*—William H. Meise; Stephen A. Young; Carlos A. Nieves

[57] ABSTRACT

A probe for use in a coax-to-waveguide transition is uniformly coated with a dielectric material by inserting the probe through an elastic membrane covering a container of uncured RTV elastomer to thereby dip the probe. The membrane wipes excess elastomer from the probe during withdrawal, and seals the RTV from ambient air to thereby prevent its premature curing in the container. If moved sideways before withdrawal, the coating thickness can be made to favor one side over another. A magnetic block is fitted into a waveguide. A slot in the magnetic block is also filled with uncured RTV elastomer. The probe is inserted into the slot, embedding it in the uncured RTV. Upon curing, the probe is protected from high voltage arcing to the waveguide. A cured RTV elastomer washer is preassembled to the probe before dipping, to precisely fill the void between the connector base and the magnetic block with a like material.

19 Claims, 6 Drawing Sheets

312
316
314
318
310
24
26
28
30
32
34
336
322
320
342
344
340
346
348
350
360
362
366
367
364
334
352
354
644
610

METHOD FOR UNIFORMLY COATING A PROBE WITH DIELECTRIC AND ASSEMBLING A COAX-TO-WAVEGUIDE TRANSITION

BACKGROUND OF THE INVENTION

This invention relates to manufacturing methods for producing a uniform coating of dielectric material on a short probe or wire, and for use of a short probe so coated for assembling a coaxial-to-waveguide electromagnetic transition.

High power phase shifters may be made by selecting the magnetic characteristics of magnetic materials such as garnets or ferrites located in the transmission path of the electromagnetic propagation. For radar antenna use, many such phase shifters may be configured together as an array. One such arrangement includes a rectangular waveguide including broad conductive walls spaced apart by narrow conductive walls. An elongated hollow garnet (ferrite core) having a rectangular cross-section is dimensioned to fit within the waveguide and to extend from one broad wall of the waveguide to the opposing broad wall. A "latch"wire extends through the hollow center of the ferrite core and is connected for receiving a control signal in the form of direct current pulses, all in known manner.

In the context of an array antenna, each waveguide phase-shifter may be associated with an antenna element. It may be inconvenient to distribute the radio-frequency signals to (and from) each of the phase shifters by means of a waveguide distribution network, because waveguide is bulky, difficult to fabricate and not readily amenable to change, rerouting or repair. Consequently, the signals may be coupled to and from the waveguide phase shifters by means of coaxial cables. Each phase-shifter, therefore, requires a transition from a coaxial transmission line to waveguide (coax-to-waveguide transition). Those skilled in the art know that antennas and transmission lines are reciprocal, and operate in the same manner for flow of signals in either direction. While a transition may be termed a "coax-to-waveguide transition", it is just as much a waveguide-to-coax transition.

Coax-to-waveguide transitions using electric probes are notorious in the art. A coax-to-waveguide transition involves coupling the outer conductor of the coaxial transmission line to the edges of an aperture in a broad wall of the waveguide, and extending the inner conductor of the coax into the waveguide to form what amounts to a small monopole antenna within the waveguide. FIG. 1 is a simplified exploded view of a coax-to-waveguide transition in the context of a phase shifter. In FIG. 1, a rectangular waveguide 10 including broad upper and lower walls 10*a* and 10*b*, respectively, and narrow side walls 10*c* and 10*d*, is dimensioned to accept an elongated garnet ferrite core illustrated as 12. Ferrite core 12 has a rectangular cross-section, the larger dimension of which is substantially equal to the dimension between broad walls 10*a* and 10*b* of waveguide 10. As illustrated in FIG. 1, ferrite core 12 is hollow, defining an elongated rectangular aperture 14 extending through its length. A pair of wires, illustrated together as 16, extends through a ceramic insulator 18 dimensioned to fit within rectangular aperture 14 in ferrite core 12. Wires 16 are adapted for carrying currents in mutually opposite directions for polarizing the core for producing the desired phase shift, all in known fashion.

As also illustrated in FIG. 1, ferrite core 14 defines a narrow slot 20 which extends from upper broad wall 10*a* to lower broad wall 10*b*. Slot 20 has a rectangular cross-section, as more clearly shown in FIG. 4*b*. An aperture 22 formed in upper broad wall 10*a* of waveguide 10 is located at a position which is centered at the end of slot 20 when ferrite core 12 is mounted within waveguide 10. A coaxial probe assembly designated generally as 24, which is similar to a coaxial panel connector, includes a threaded coaxial SMA connector 26 coupled through a coaxial right-angle transition 28 and coaxial section 30 to a baseplate 32. The center conductor of the coaxial section (not illustrated in FIG. 1) extends beyond baseplate 32 to form probe or "stinger" 34. Baseplate 32 includes mounting holes, one of which is designated 38, which mate with studs or rivets, one of which is designated 40, which are affixed to and extend above upper broad waveguide wall 10*a*. Studs 40 are spaced relative to aperture 22 so that baseplate 32 of assembly 24 positions probe 34 in slot 20 of core 12 when baseplate 32 is indexed to the studs and bears against the upper surface of waveguide wall 10*a*.

A waveguide short-circuit terminates the rear of the waveguide and is illustrated in FIG. 1 as a conductive block 46, which is dimensioned to fit within the near end of waveguide 10. Holes illustrated as 48 are indexed with matching clearance holes, one of which is illustrated as 50, so that short circuit block 46 may be fastened securely in place by means of rivets (not illustrated).

FIG. 2 illustrates waveguide 10 with ferrite core 12 and other parts mounted within, and also illustrates assembly 24 mounted thereon, in phantom for clarity. Elements of FIG. 2 corresponding to those of FIG. 1 are designated by the same reference numerals.

As so far described, signals flowing between waveguide 10 and coaxial connector 26 make the transition by means of probe 34 which extends into slot 20 of ferrite core 12. At high power levels, arcing may take place between probe 34 and adjacent structures, notably ferrite core 12 and the periphery of aperture 22. It is theorized that the arcing is attributable to the relatively low breakdown voltage of air and the small clearance between the probe and its adjacent structures.

In order to provide a higher breakdown voltage between the probe and adjacent structures, an assembly method was used by which a room temperature vulcanizing silicone elastomer (RTV elastomer) was injected by hand into slot 20 just before connector assembly 24 was assembled to the waveguide and ferrite core 12. While this improved the power handling capability of the assembly, unit-to-unit variations in the power handling capability were noted. The unit-to-unit variations in power handling capability were attributed to manual assembly of each connector assembly 24 to its waveguide-ferrite core assembly. In order to rigidly control the assembly procedure, a robotic system was devised by which robotic injection of RTV into slot 20 was followed by robotic insertion of connector assembly 24 to the waveguide-ferrite core assembly. The connector assembly was inserted by translating the connector assembly in a direction parallel with the axis of the probe directly into final mounting position.

Piece-to-piece variations in the performance were still found. When the joints were dissected, voids were found in the cured elastomer. It is believed that a void-free dielectric filling is necessary for consistent high power performance. An improved assembly method is desired.

SUMMARY OF THE INVENTION

In accordance with the invention, the exterior of an elongated electrical conductor adapted for electromagnetic radiation is coated with a thin layer of dielectric material by a method including the step of maintaining a container of uncured or liquid room-temperature vulcanizing (RTV) elastomer covered by a thin rubber or elastic membrane which, by preventing its exposure to air-borne moisture, keeps the elastomer from curing quickly By inserting or dipping the conductor through the membrane into the uncured elastomer the elongated electrical conductor is wetted with the uncured elastomer, and when the conductor is withdrawn, it is coated with a thin film of liquid elastomer. According to another embodiment of the invention, the wetted conductor is assembled to a waveguide assembly immediately after being wetted. According to a further embodiment of the invention, a pre-cured elastomer washer is mounted over the conductor before dipping.

Figure 1:
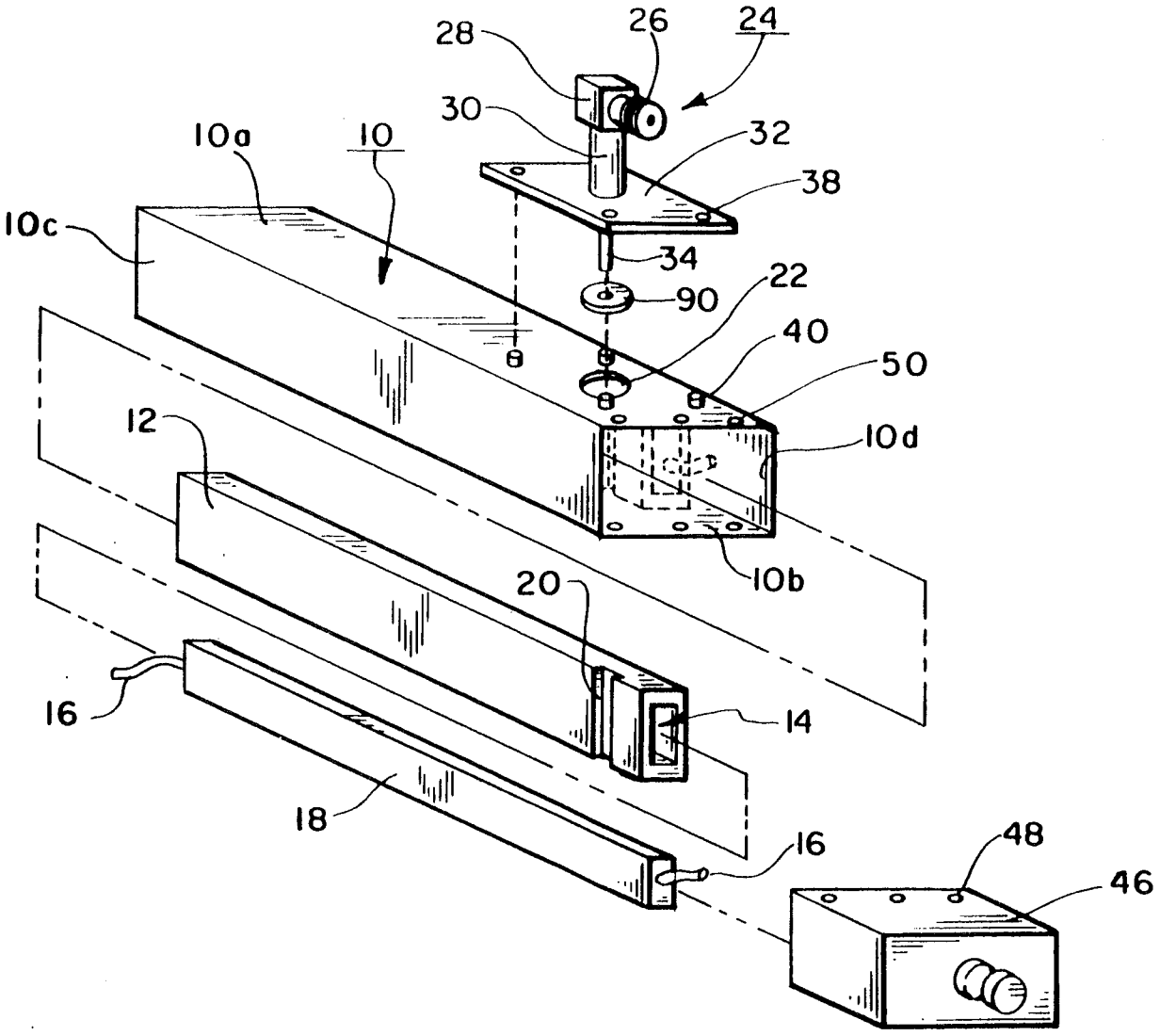
FIG. 1 is a simplified exploded view, in perspective or isometric view, of a waveguide phase shifter including a coaxial-to-waveguide transition.
Figure 2:
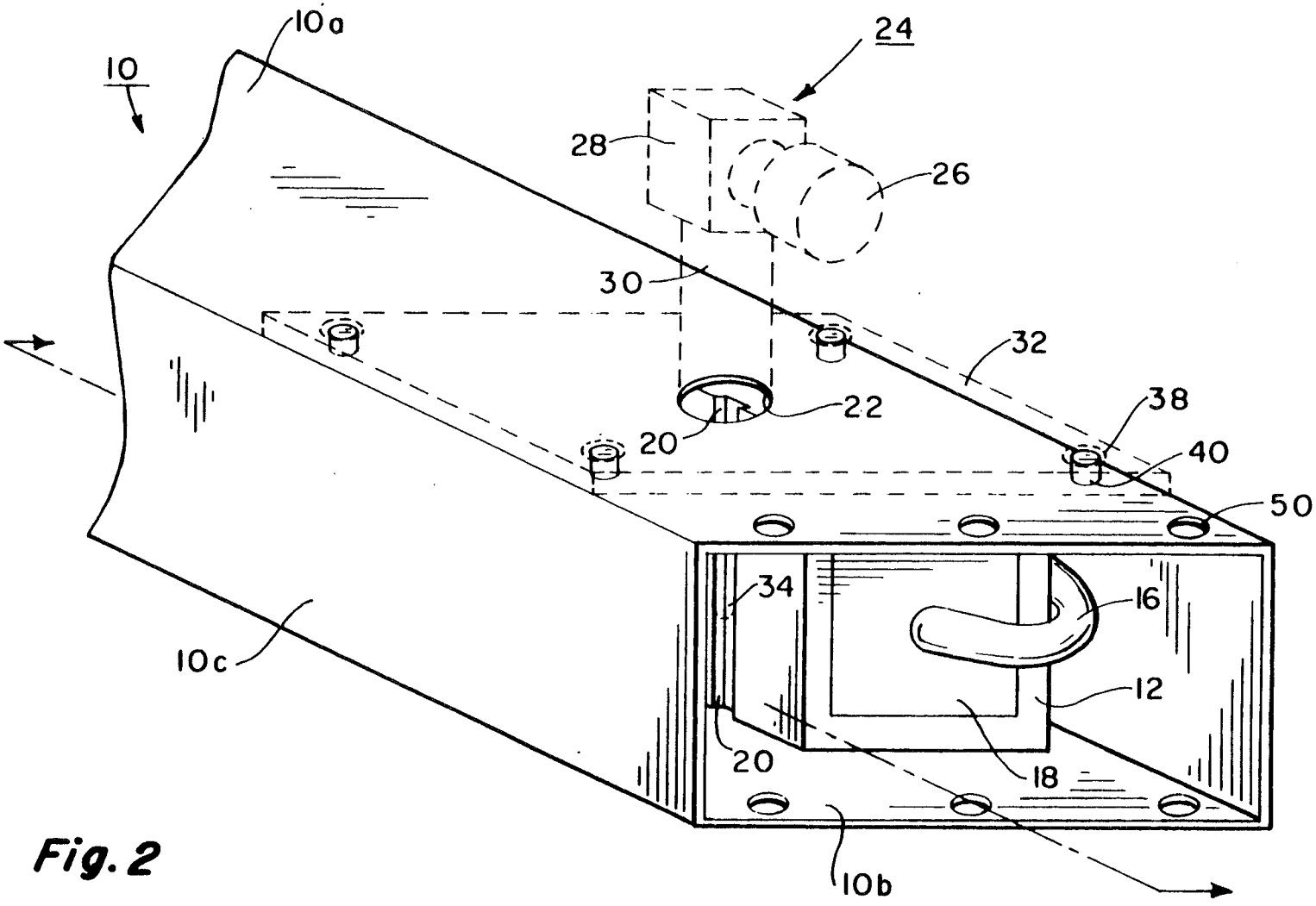
FIG. 2 is a partial view of the arrangement of FIG. 1 in assembled form, with a portion illustrated in phantom for ease in understanding.
Figure 5:
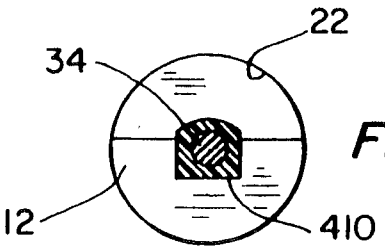

FIG. *3a* is a simplified perspective or isometric view of a coaxial probe assembly being picked up by a robot gripper, FIG. *3b* illustrates the gripper translating the coaxial probe assembly to a further step, FIG. *3c* illustrates the gripper holding the coaxial probe assembly above a membrane-covered container full of RTV elastomer in preparation for dipping the probe, FIG. *3d* is an elevation view, partially in cross-section, of robot motions performed for wetting the probe with liquid RTV elastomer, FIG. *3e* illustrates the coaxial probe assembly in a position in which the probe is fully inserted into a container of liquid elastomer, FIG. *3f* illustrates a coaxial probe assembly with a washer according to another embodiment of the invention, FIG. *3g* illustrates in perspective or isometric view the washer of FIG. *3f*, and FIG. *3h* illustrates, in cross-sectional elevation view, the probe penetrating the membrane and translated to produce a gap; FIGS. *3a* through *3h* are together referred to as FIG. 3;

FIG. *4a* is an elevation view, partially exploded, of the structure of FIG. 2, taken along section lines *4a*—*4a*, and FIG. *4b* is a plan view of the structure which is visible through aperture 22 of FIG. 2 after injection of RTV elastomer into a slot;

FIG. 5 is an elevation view, partially cut away, of the assembly of a probe into a slot in accordance with the invention; and FIG. *6a* is a perspective or isometric view of a jig which may be used to aid in placing clamps on the membrane in a uniform manner, and FIG. *6b* illustrates a clamp which provides uniform pressure.

DESCRIPTION OF THE INVENTION

Referring to FIG. 3, FIG. *3a* illustrates a coaxial probe assembly feeder 310 which feeds a sequence of coaxial probe arrangements 24 to a particular location at which they can be picked up by a robot. The robot is illustrated by an arm 312 and mutually opposed grippers 314 and 316. As indicated in FIG. *3a*, arm 312 and the grippers move in a direction of arrow 318 to grasp the connector in known fashion. FIG. *3b* illustrates the translation of a coaxial probe assembly 24 by the robot arm and grippers from feeder 310 (FIG. *3a*) to another location, illustrated in FIG. *3c*.

FIG. *3c* illustrates the positioning of robot arm 312, with grippers 314 and 316 gripping assembly 24, with probe 34 directly over a container 320 filled with liquid elastomer. An elastic membrane 322 is stretched over the opening or mouth of container 320. As illustrated, the axis of elongation 336 of probe 34 is vertical.

Also illustrated in FIG. *3c* is one of a pair of pinch clamps designated generally as 340. Each clamp 340 includes first and second hinged arms 342 and 344, so arranged that they may pinch the elastic material therebetween. A screw and wing nut 346 and 348, respectively, are hinged to arm 342 and coact with a notch 350 to hold arms 342 and 344 closed to maintain the pinching or clamping action or membrane 322. Pinch clamp 340 and a mating piece (not illustrated) are used as an aid for holding elastic membrane 322 stretched across the mouth of container 320.

FIG. *3d* is an elevation view, partially in cross section, of the arrangement of FIG. *3c*. As illustrated in FIG. *3d*, container 320 is held within a recess 352 in a block 354 solidly mounted on a support surface (not illustrated). As illustrated in FIG. *3d*, membrane 322 is stretched across the mouth of container 320, and is held in place by the elasticity of the membrane material coacting with the fixed locations of lug pairs 360 and 362 which bear against the ends of arms 342 and 344 of assembly 340 and of its mating assembly.

In operation, referring to FIG. *3d*, robot arm 312 and grippers 314 and 316 lower coaxial probe assembly 24 in the direction of arrows 364 parallel to axis 336. Eventually, rounded end 334 of probe 34 will reach and penetrate through membrane 322. Further lowering of assembly 24 by the robot arm causes probe 34 to penetrate membrane 322 and dip into the uncured RTV elastomer, designated 366 in FIG. *3d*. The robot may be controlled to dip probe 34 to any predetermined depth. For assembly of a waveguide phase shifter as described below, the robot controls the dipping to a depth such that the bottom of baseplate 32 touches the top of membrane 322.

Following the dipping of the probe 34 into the uncured RTV elastomer by penetration of membrane 322, robot arm 312 with its grippers 314 and 316 raises connector assembly 24, still parallel to axis 336, in the direction of arrows 367. As probe 34 is withdrawn, the perimeter of the hole in elastic membrane 322 wipes excess RTV elastomer away from the surface to provide a uniform coating. Also, the hole through which probe 34 penetrated elastic membrane 322 closes following withdrawal of the probe, so that the liquid elastomer is not exposed to air excessively, and tends to remain uncured or "liquid". When the probe has been fully withdrawn, the coated probe and connector assembly is transported by the robot for further processing. The next step of processing might be a curing step, or it might be a step of assembling the coaxial probe assembly with wetted probe to a waveguide-ferrite core assembly, as described in conjunction with FIG. *4a*.

Membrane 322 may be a latex membrane such as a finger cot, a thumb cut from a vinyl rubber glove, or a rubber prophylactic. It has been found that rounded end 334 of probe 34 may not be sufficiently sharp to reliably puncture such materials. A pin hole is therefore first punctured in the membrane at the location at which the probe is to be inserted. Because of the repeatability of the robotic operation, indexing or alignment of the probe with the pin hole is not a problem.

Figures 3A, 3B, 3C, 3D, 3E:
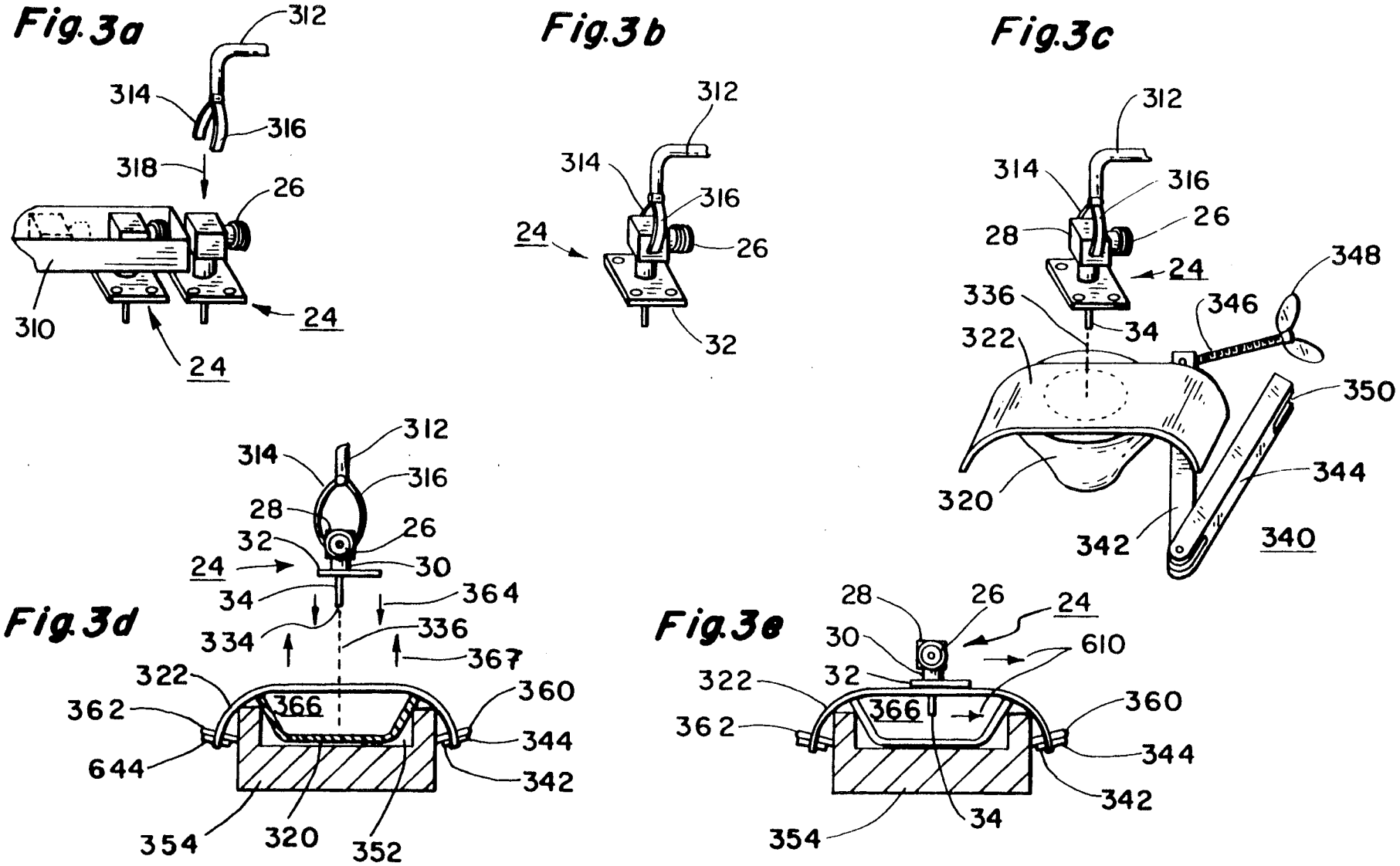

It may be advantageous to perform a pre-bending of probe 34 before the wetting step described in conjunction with FIG. 3*d*, to slightly pre-bend probe 34 so that, when the probe is robotically inserted into slot 20 against the resistance or pressure of the uncured RTV fill, it tends to be flexed into a straight condition, matching the slot.

It has been found that, with repeated operations, small amounts of liquid elastomer may be drawn from container 320 and be deposited on the top of membrane 322, at which point it tends to adhere, during later dipping cycles, to baseplate 32 of successive coaxial probe assemblies 24 or to the dielectric spacer contiguous with baseplate 32 which is an ordinary part of the coaxial structure. This tendency may be counteracted by programming the robot to insert probe 34 at randomly selected locations across the surface of the membrane covering the mouth of container 320. Because it may be difficult to create pin holes in the selected location pattern, an alternative membrane material has been used which allows the rounded end of a 0.038-inch diameter probe to readily penetrate without prepuncturing, and which at the same time provides a satisfactory seal over the mouth of container 320 to prevent premature curing of the RTV elastomer 366. The alternative material is a closed-cell silicone sponge sheet. Such a sponge sheet is available as type WS10182 from Colonial Rubber of 19 Elbo Lane, Mount Laurel, N.J. This sponge has a military specification type MIL R46089. It is available in several thicknesses. Any thickness appropriate to the intended application may be used. Naturally, a very thick sheet will prevent penetration of the probe to its full length. A $\frac{1}{8}$ inch thickness has been found to be suitable. A similar material is available from CHR Industries, 407 East Street, New Haven, Conn. 06509 as type R10460 silicone sponge rubber. The uncured elastomer which has been used with the aforementioned type WS10182 membrane is "3145 Adhesive Sealant, clear", a silicone rubber sealing and caulking compound available from Dow Corning. Similar materials are readily available, such as RTV 511 silicone rubber compound, available from General Electric Company.

It is believed that the resulting improvement in the unit-to-unit variability comes about because the wetted probe 34 makes consistent contact with the uncured RTV elastomer in the groove 20 during insertion, so that the elastomer in the groove coats the probe completely and is not pulled in such a manner as to form voids at random locations along the length of the probe.

Figure 4A:
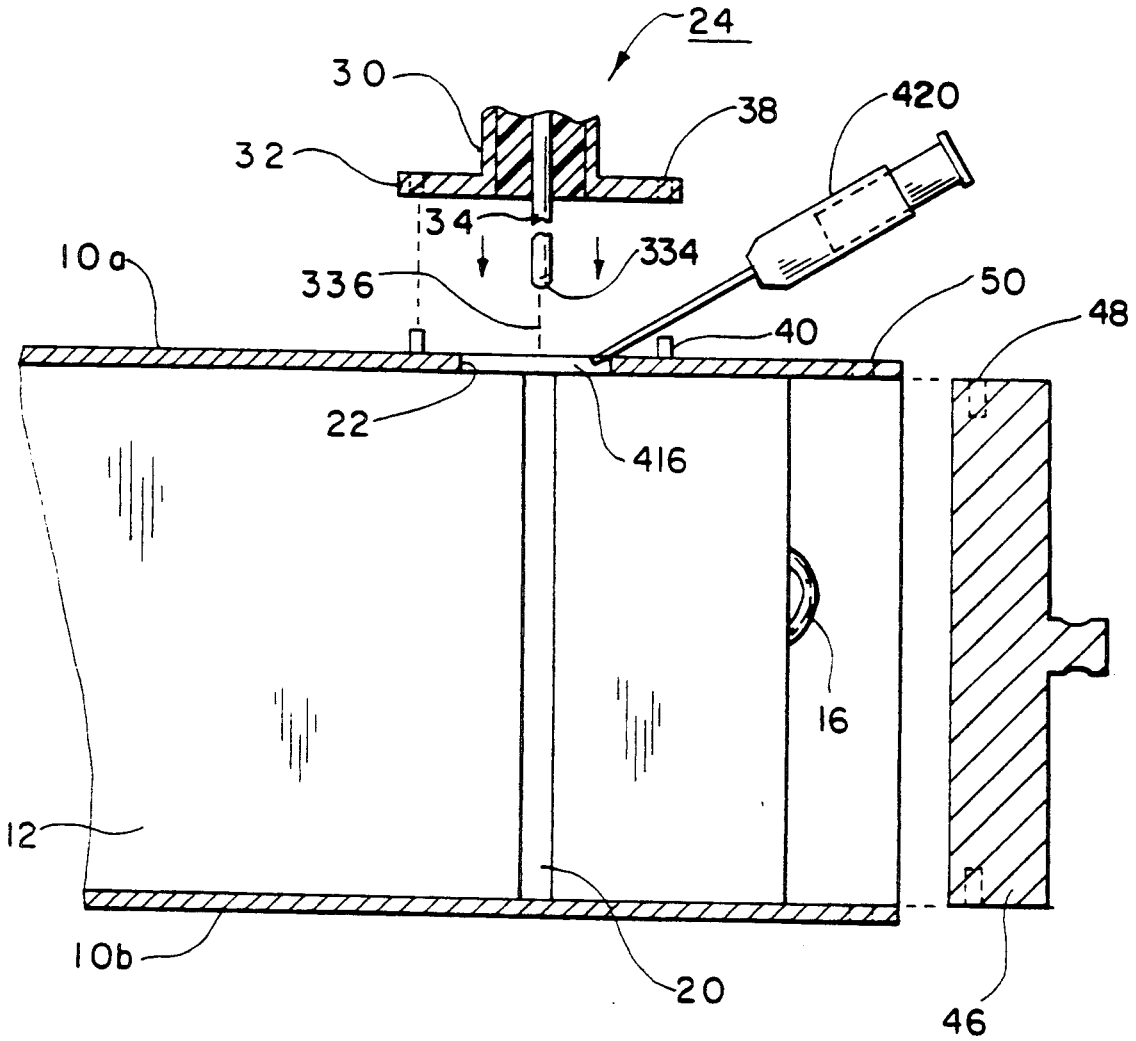
Figure 4B:
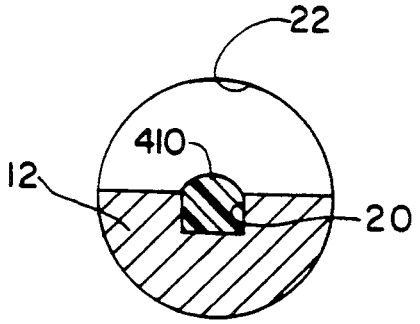

FIG. 4*a* is an elevation view, sectioned, illustrating the robotic insertion of the probe 34 into the assembly of waveguide 10 with ferrite core 12. In FIG. 4*a*, robotic injection of uncured RTV elastomer into slot 20 has already occurred, as illustrated by the end-on view of FIG. 4*b*. In FIG. 4*b*, the elastomer is illustrated as a deposit 410. Robot arm 312 (not illustrated in FIG. 4*a*) lowers coaxial probe assembly 24 parallel with axis 336, so that probe 34 is lowered directly into slot 20.

If assembly takes place as so far described, it has been found that under high electrical power condition there is a possibility of creation of arcing in the region between the base of probe 34 and the periphery of aperture 22 in waveguide wall 10*a*. This arcing occurs in a small cavity formed over the ferrite core because of the thickness of the waveguide wall 10*a*. The cavity occurs between baseplate 32 and the top of ferrite core 12, and is bounded by the periphery of aperture 22 and the surface of probe 34. The cavity is designated 416 in FIG. 4*a*. It has been found that if cavity 416 is filled with uncured RTV elastomer just before the connector is robotically inserted, the arcing sensitivity problem is materially reduced. An accepted procedure is to manually "paint" the exposed semicircular surface of the ferrite core with elastomer injected manually from a syringe, illustrated in FIG. 4*a* as a syringe 420, before assembly of coaxial probe assembly 24 to the waveguide ferrite core assembly. However, it was found that there was a tendency to either underfill or overfill the cavity. Underfilling allows arcing to occur, while overfilling results in some elastomer being spilled or extruded into the junction between connector baseplate 32 and the outer surface of waveguide wall 10*a* during the final phase of assembly, whether manual or robotic. This spilled elastomer adversely affects the electrical impedance of the interface.

Figure 3H:
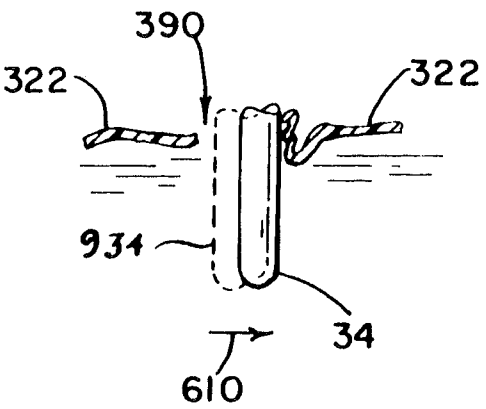
Figure 3F:
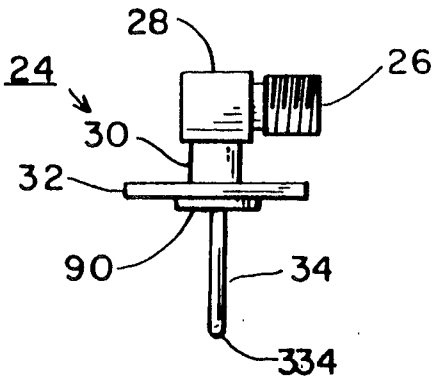
Figure 3G:
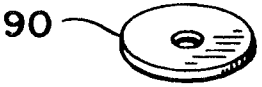

In accordance with a further embodiment of the invention, a washer cut from a sheet of cured elastomer is mounted onto probe 34 of connector assembly 24 before insertion of the probe into the container of uncured RTV elastomer for wetting of the probe FIG. 3*f* is an elevation view of coaxial probe assembly 24, showing an elastomer washer 90 mounted over the probe 34. The cured RTV elastomer washer 90 is made by filling a flat cavity dimensioned to slightly exceed the thickness dimension of cavity 416. The cavity is filled with uncured RTV elastomer by use of a squeegee. After the elastomer has cured, the required disc is punched from the sheet with a center hole diameter of about 0.038 inches. This represents a slight interference fit with probe 34 which thereby retains washer 90 in place during subsequent operations. Elastomer washers 90 have been made from "3145, RTV, Clear," a silicone adhesive sealant, available from Dow Corning Corporation. When removed from the cavity, the cured RTV sheet is slightly oversized by about 0.001 inch in thickness. The washer is cut from the sheet slightly undersized in diameter for the space, so that pressing coaxial probe assembly 24 into place on waveguide wall 10*a* over the washer causes it to compress, whereby it expands slightly in diameter to uniformly fill cavity 416.

It may be desirable to produce a repeatable coating of dielectric material on the probe 34 with a thickness which is different on one side of the probe than on the opposite side. This might be desired, for example, to guarantee filling of the interstices between rectangular slot 20 and round probe 24. In FIG. 5, a coating of liquid elastomer might advantageously be used which is thicker on the side of probe 34 which, when assembled, faces into slot 20. Such a coating is readily accomplished by slightly translating the coaxial probe assembly 24 transversely (in a "forward" direction), in the direction of arrows 610 in FIG. 3*e*, and maintaining the laterally translated position during withdrawal, in the direction of arrows 366 of FIG. 3*d*. This slightly stretches the membrane to create a slight gap, or at least less membrane tension, on the lagging or rearward side of the probe. In FIG. 3*h*, probe 34 is illustrated as translated in the direction of arrow 610 from its position, designated 934, which it had upon penetration of the membrane The translation results in a gap 390. The gap or lessened membrane tension allows a thicker coating of liquid elastomer to adhere to the probe during withdrawal.

Figure 6B:
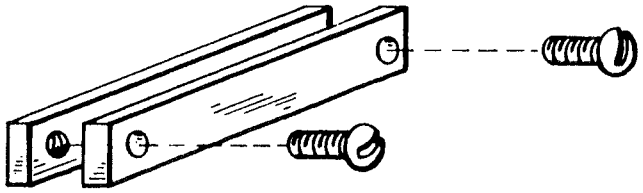
Figure 6A:
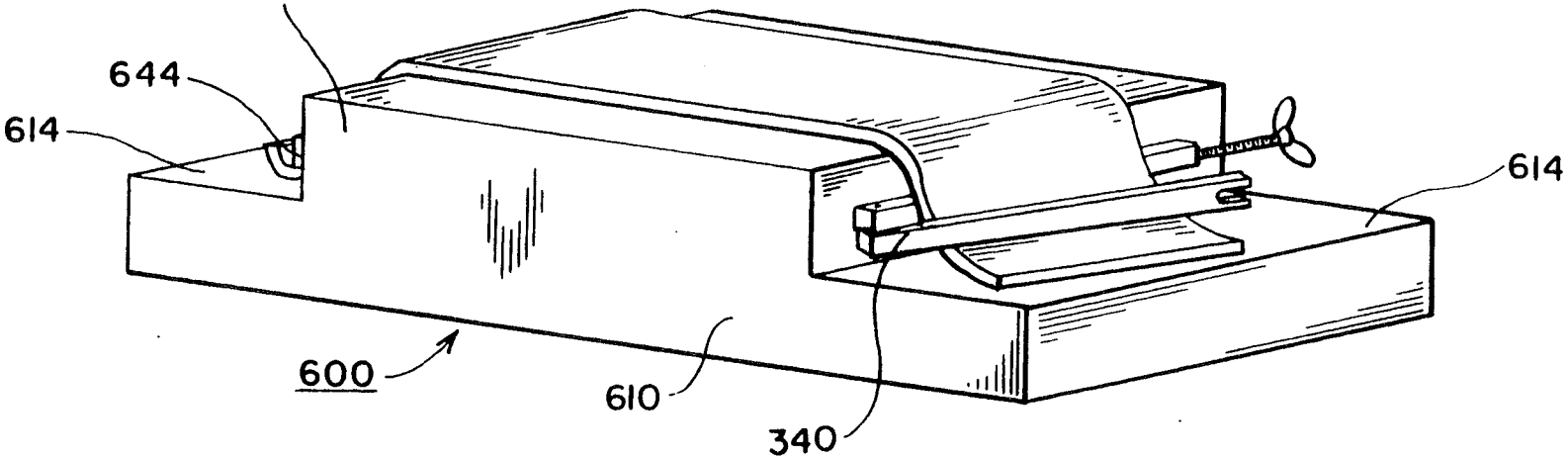

FIG. 6*a* is an isometric or perspective view of a jig, designated generally as 600, which is used for consistently locating clamps on the elastic membrane, so that when installed across the mouth of the container with the clamps held by lugs as illustrated in FIG. 3*d*, the membrane is always stretched or tensioned by the same amount. In FIG. 6*a*, jig 600 includes a jig body 610 including a salient or raised portion 612 set at a predetermined distance above a "floor" level determined by bipartite surface 614. Membrane 322 is threaded through pinch clamp sets 344 and 644, with the clamps loosened. Clamp set 340 is set against floor surface 614, and its mating set 644 also rests on a surface 614. The clamps are then tightened, and the clamped membrane is ready for use. FIG. 6*b* illustrates a simple type of clamp set which has been found to provide easy adjustment and uniform pressure across the membranes.

Other embodiments of the invention will be apparent to those skilled in the art. For example, membranes 322 of FIG. 3*d* may have thicknesses other than ⅛ inch and may be formed from other elastic materials and those described The membrane may be stretched across the mouth of the container by means other than the clamps and lugs described A particular advantageous scheme such as impaling the ends of the membrane on spikes affixed to housing 354 might be used. Instead of assembling coaxial probe assembly 24 to a waveguide as described in conjunction with FIGS. 3 and 4, the wetted probe may be placed aside and allowed to dry for use in other arrangements. The cured washer 90 in FIG. 3*f* may be molded in place against baseplate 32 of coaxial probe assembly 24 and provided as an integral assembly. An additional layer of uncured elastomer may be manually applied over slot 20 and probe 34 after assembly of coaxial probe assembly 24 to the waveguide and ferrite core assembly.

What is claimed is:

1. A method for coating the exterior of an elongated electrical conductor adapted for electromagnetic radiation with a thin layer of dielectric material, comprising the steps of:

maintaining a container full of uncured room-temperature-vulcanizing (RTV) elastomer, said container having an aperture sealed by a thin elastic membrane whereby said elastomer tends to remain uncured;

inserting said conductor through said membrane into said uncured elastomer to a predetermined depth, whereby at least a portion of said conductor is immersed in liquid elastomer; and removing said conductor wherein a thin coating of elastomer clings to said portion.

2. A method according to claim 1 wherein said membrane is selected to be one of a silicone sponge material and a latex membrane, and wherein, when said membrane is selected to be a latex membrane, a step of prepuncturing said membrane is performed before said inserting step, to thereby define a dilatable aperture.

3. A method according to claim 2 further comprising, when said latex membrane is selected during said selecting step, the further step of positioning said conductor so that the axis of elongation of said conductor is aligned with said dilatable aperture .

4. A method according to claim 2 wherein said inserting step is performed by axial motion of said conductor in a direction perpendicular to said membrane.

5. A method according to claim 2 wherein said inserting step is performed by motion of said conductor in a direction parallel to said axis of elongation.

6. A method according to claim 5 further comprising the step, before said removing step, of translating said conductor in a direction transverse to said axis of elongation, for thereby stretching said dilatable aperture, whereby said removing step causes the elastomer adhering to said conductor to be thicker on one side than on the other side.

7. A method according to claim 5 wherein said removing step is performed by a motion of said conductor in a direction parallel to said axis of elongation.

8. A method for assembling a coax-fed electromagnetic launcher to a magnetic phase shifter, said phase shifter including a magnetic block assembled into a waveguide, said magnetic block extending between first and second opposed walls of said waveguide, said magnetic block further including a slot formed in the side thereof, said slot also extending between said first and second opposed walls of said waveguide, said waveguide further including an aperture in one of said opposed walls of said waveguide, said aperture being located adjacent to and exposing an end of said slot, said launcher including an elongated probe adapted to fit through said aperture and to extend into said slot, said launcher also including a baseplate including an aperture through which said probe extends in an insulated and coaxial manner, said method for assembling comprising the steps of:

inserting a hollow needle through said aperture and along said slot;

injecting uncured elastomer through said needle while withdrawing said needle, thereby depositing said elastomer in said slot;

inserting said probe through an elastic membrane into a vessel containing uncured elastomer to thereby wet and coat the surface of said probe with elastomer material;

removing said probe from said membrane and vessel, whereby excess elastomer is wiped from the exterior of said probe, leaving it coated and wetted; and inserting said probe coated and wetted with elastomer through said aperture and into said slot in said magnetic block until said baseplate bottoms against the outer surface of said one of said waveguide walls.

9. A method according to claim 8 wherein said step of inserting said probe through said aperture creates a cavity between said baseplate and said magnetic block, which cavity is bounded by the edge of said aperture, and further comprising the step of filling said cavity with elastomer.

10. A method according to claim 9 wherein said step of filling said cavity comprises the step of applying liquid elastomer to that portion of said magnetic block exposed by said aperture.

11. A method according to claim 10 wherein said step of filling said cavity comprises the step of flowing liquid elastomer through a hollow needle onto said exposed portion of said magnetic block.

12. A method according to claim 10 wherein said step of applying liquid elastomer is performed before said step of inserting said probe through said aperture and into said slot.

13. A method according to claim 9 wherein said step of filling said cavity comprises the step of placing a cured elastomer washer over said probe.

14. A method according to claim 13 wherein said step of placing a washer over said probe is performed before said step of inserting said probe through an elastic membrane.

15. A method according to claim 8 wherein said step of inserting said probe into said slot is performed before said elastomer in said slot cures.

16. A method according to claim 15 wherein said step of inserting said probe into said slot is performed before curing of said liquid elastomer wetting said probe.

17. A method according to claim 16 wherein said step of inserting said probe through said aperture creates a cavity between said baseplate and said magnetic block, said cavity being bounded by the edge of said aperture, and further comprising the step of filling said cavity with elastomer.

18. A method according to claim 17 wherein said step of filling said cavity comprises the step of applying liquid elastomer to that portion of said magnetic block exposed by said aperture

19. A method according to claim 18 wherein said step of inserting said probe into said slot is performed before curing of the liquid elastomer applied in said step of applying liquid elastomer to that portion of said magnetic block exposed by said aperture.

* * * * *